United States Patent [19]

Fagnoni

[11] Patent Number: 4,534,141

[45] Date of Patent: Aug. 13, 1985

[54] TRANSPORTABLE PRE-FABRICATED BUILDING STRUCTURE

[76] Inventor: Giovanna Maria Fagnoni, V. Pian dei Giullari 86, Firenze, Italy

[21] Appl. No.: 503,501

[22] Filed: Jun. 13, 1983

[30] Foreign Application Priority Data

Jun. 18, 1982 [IT] Italy ..... 9442 A/82

[51] Int. Cl.[3] ..... E04B 1/343

[52] U.S. Cl. ..... 52/68; 52/69; 52/126.1

[58] Field of Search ..... 52/79.5, 71, 68, 69, 52/126.7, 126.1; 296/162, 165, 169, 170, 172, 173, 174, 176

[56] References Cited

U.S. PATENT DOCUMENTS

| | | | |
|---|---|---|---|
| 436,668 | 9/1890 | Leonard | 52/79.5 |
| 2,181,844 | 11/1939 | Winters | 52/69 |
| 2,780,844 | 2/1957 | Bolt | 52/69 |
| 3,857,211 | 12/1974 | Sharpton | 52/68 |
| 4,242,846 | 1/1981 | Hurd et al. | 52/71 |
| 4,464,868 | 8/1984 | Howroyd | 52/68 |

FOREIGN PATENT DOCUMENTS

| | | | |
|---|---|---|---|
| 260809 | 12/1964 | Australia | 52/68 |
| 2309061 | 9/1973 | Fed. Rep. of Germany | 52/68 |
| 953714 | 5/1949 | France | 296/169 |
| 1134409 | 12/1956 | France | 52/68 |
| 56452 | 6/1967 | German Democratic Rep. | 296/169 |
| 574311 | 3/1958 | Italy | 52/68 |
| 559004 | 12/1958 | Italy | 52/68 |
| 291760 | 7/1953 | Switzerland | 52/71 |
| 761276 | 11/1956 | United Kingdom | 52/68 |

*Primary Examiner*—Henry E. Raduazo
*Assistant Examiner*—Caroline Dennison
*Attorney, Agent, or Firm*—McGlew and Tuttle

[57] ABSTRACT

A supporting framework is formed by an arrangement including closed longitudinal frames (3,9,12,14) integral with base beams (16A) forming support and sliding runners, with a floor panel (9), a roof panel (14), and end walls (10,12), all defining a usable space. Along lower longitudinal axes are pivoted, on each side, panels (40) foldable for lowering and panels (34) foldable for raising, which are adapted to form respectively a flooring and a roofing, together with panels (44) adapted to form longitudinal vertical walls for additional spaces, which are adapted to be supported by adjustable legs (24) on the ground. To the end walls (10,12) are vertically pivoted panels (30) adapted to open out to form vertical walls completing the additional spaces.

17 Claims, 31 Drawing Figures

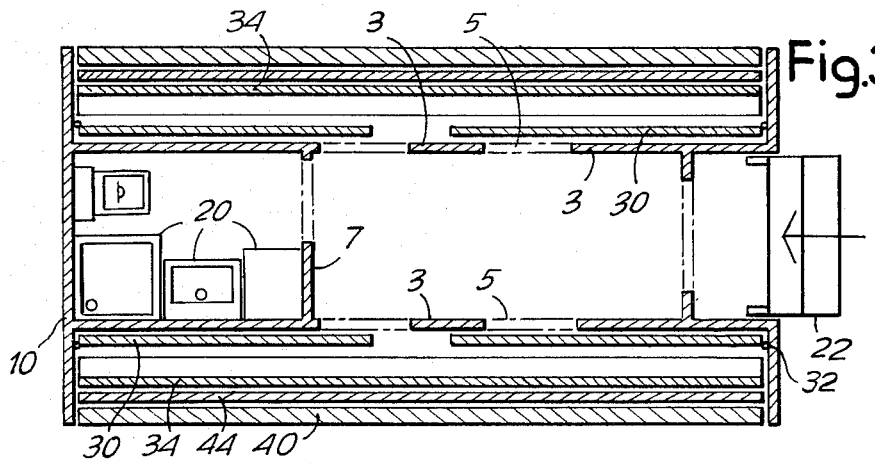
Fig.3
Fig.4
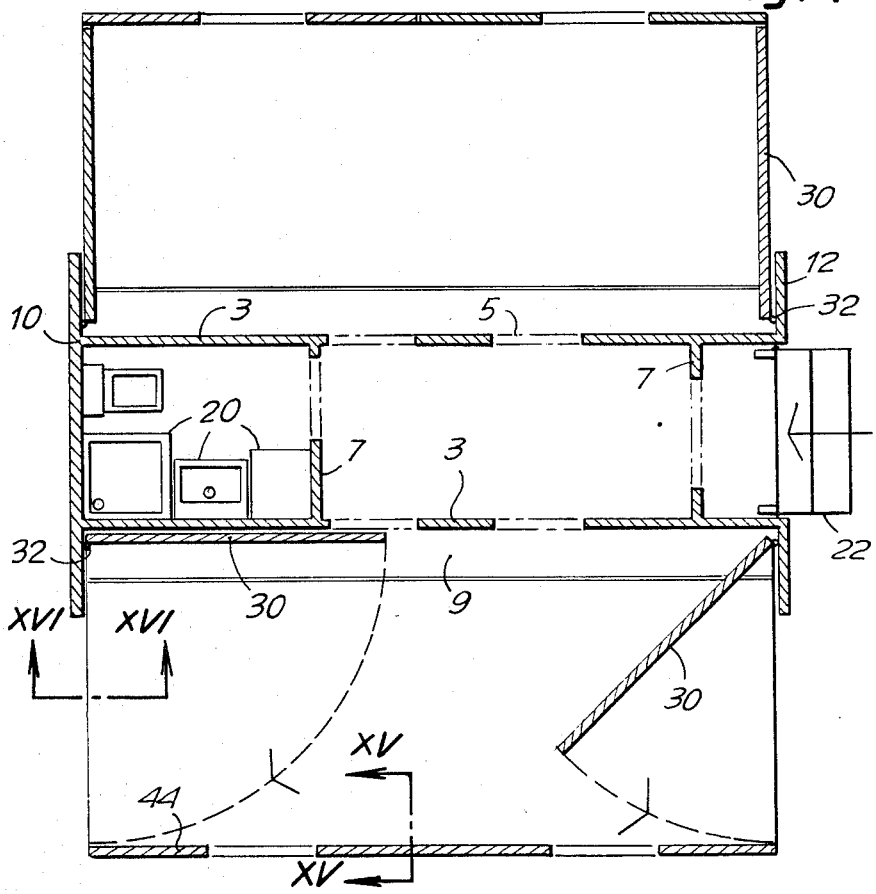

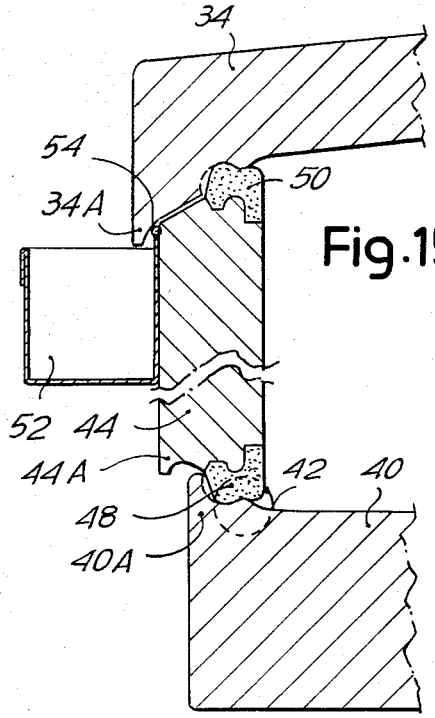
Fig.15
Fig.16
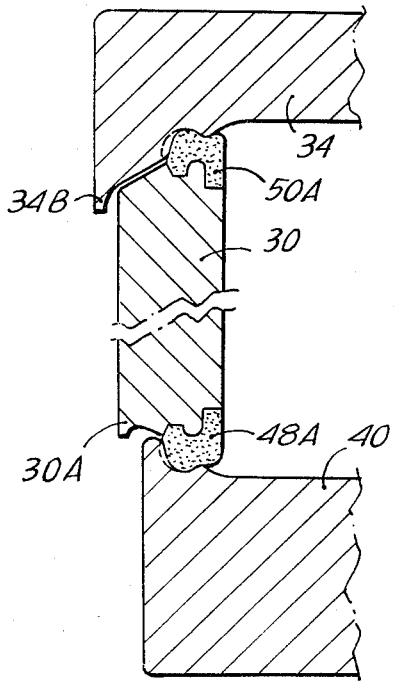
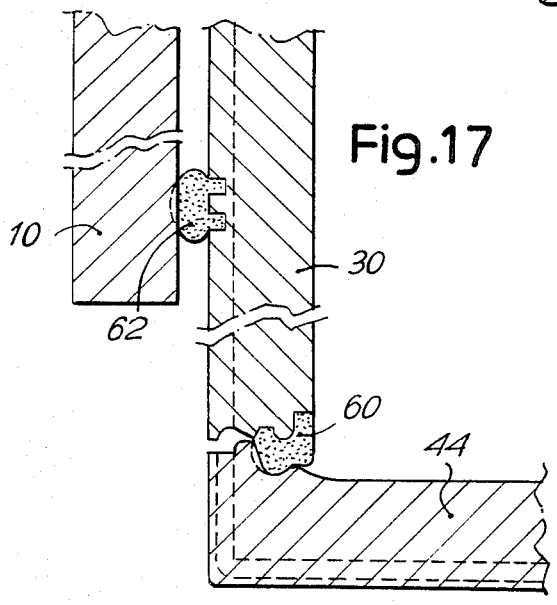
Fig.17

TRANSPORTABLE PRE-FABRICATED BUILDING STRUCTURE

BACKGROUND OF THE INVENTION

1. Field of the Invention

This invention relates to a transportable building structure intended to form a shelter or dwelling and suitable for immediate use in cases of emergency, and for other uses.

2. Summary of the Prior Art

Pre-fabricated buildings are well known and have the main advantage that a substantial proportion of the manufacturing effort is carried out independently of the weather in a factory. However, the on site work remains a reasonably substantial proportion of the effort since independently transported sections must be assembled together on site. It is an object of the invention to provide a transportable building structure, in which event in the transportation configuration substantially all the parts are interconnected so that on site it is only necessary to move the component parts relatively to one another to their final configuration.

SUMMARY OF THE INVENTION

According to the present invention there is provided in a building structure a framework including elongate members, support and runner base beams, a flooring member, a roofing member, and end wall members, all of these members and beams being rigidly interconnected to define a useful space, further flooring panel members pivoted to the framework at axes extending parallel to the beams and elongate members, further roofing panel members pivoted to the framework at axes extending parallel to the beams and elongate members, further wall members one being pivoted to each further flooring panel member and pivotal, when the corresponding further flooring member is in situ, to a vertical orientation, and further, panel, wall members pivoted to the end wall members about respective vertical axes and movable into configurations wherein corresponding further flooring panel members, further roofing panel members and further wall members together define a further useful space when pivoted to orientations extending outwardly from the framework.

In the transportation and storage configuration the articulated panels are preferably accommodated between the end wall members, the flooring members, and the roofing member.

The further panel members forming the roofing are advantageously pivoted below the roofing member of the framework. The panel members forming the floor are preferably pivoted at the edge of the flooring member of the framework. The further panel member forming a longitudinal vertical wall is pivoted on the further panel member forming the flooring, on the opposite side to the pivot axis of the latter to the framework. The arrangement is such that in the transportation and storage state the free further panel members lie face-to-face, the flooring panel member being on the outside and the roofing panel member on the inside. Of the three panel members lying face-to-face, at least the flooring panel member and the longitudinal vertical wall panel member may be slightly inclined in the upwards direction and in the outwards direction, to give them a spontaneous tendency to move downwards.

The top edge of the panel member forming the longitudinal vertical wall and the outer edge of the panel member forming the roofing may be adapted to interlock with the aid of sectional members, which also form drip members, and gutters may be provided, which are optionally foldable.

In one practical embodiment the base beams forming runners are of double T-section, or of other section defining lateral recesses and the recesses each accommodate a leg pivoted thereon and adapted to open out horizontally. These legs may carry adjustable support feet and are adapted to support the further floor panel members.

The invention will now be described, by way of example, with reference to the accompanying diagrammatic drawings in which:

FIGS. 3 and 4 show, in horizontal section, the same structure in the same two configurations;

FIGS. 15, 16 and 17 show partial local sections to a much enlarged scale, respectively, on the lines XV—XV and XVI—XVI in FIG. 4 and on the line XVII—XVII in FIG. 2;

Figure 1:
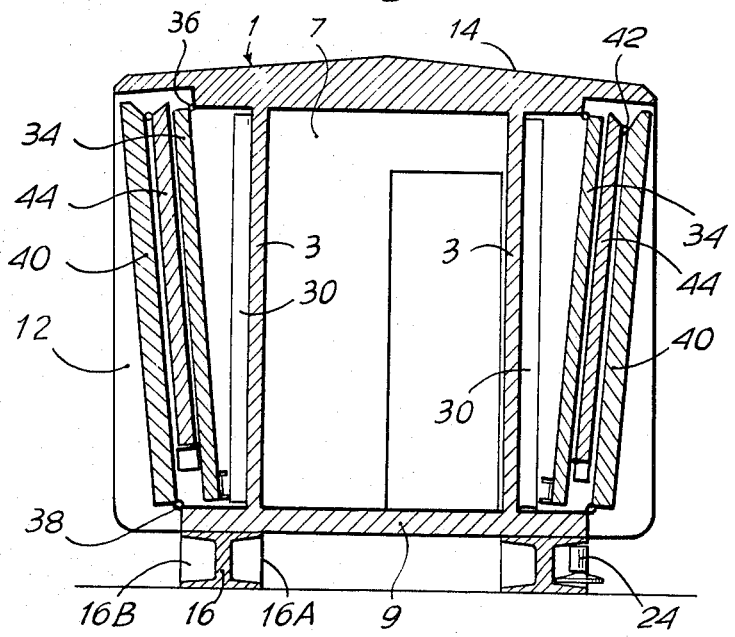
FIGS. 1 and 2 show a structure in cross-section in a storage configuration and in the configuration of use respectively.
Figure 2:
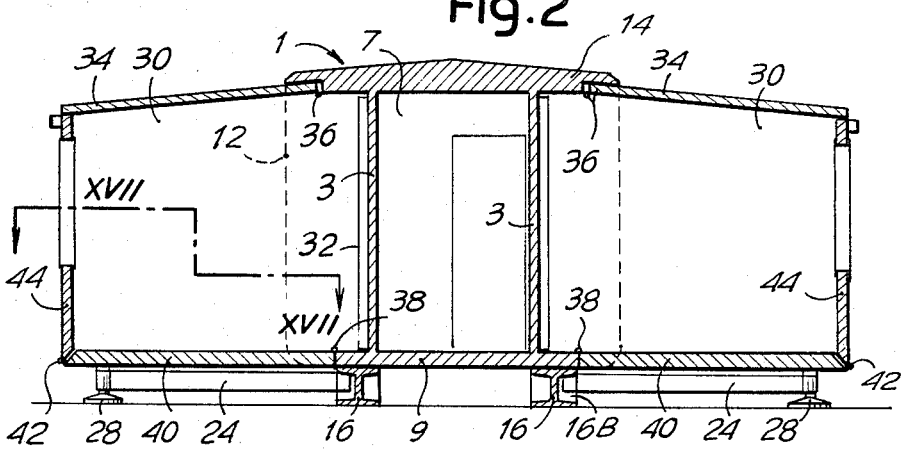
Figure 5:
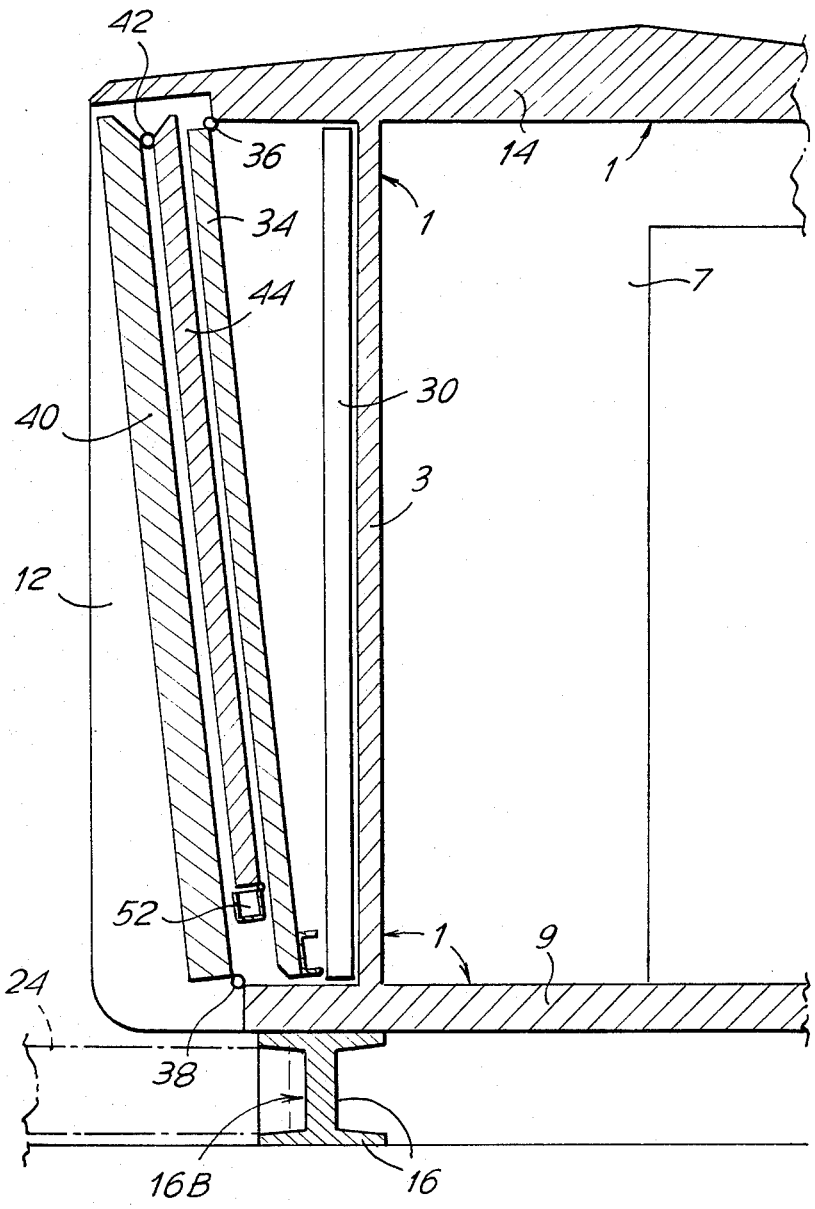
FIG. 5 shows, to an enlarged scale, a detail of the structure as shown in FIG. 1.
Figure 6:
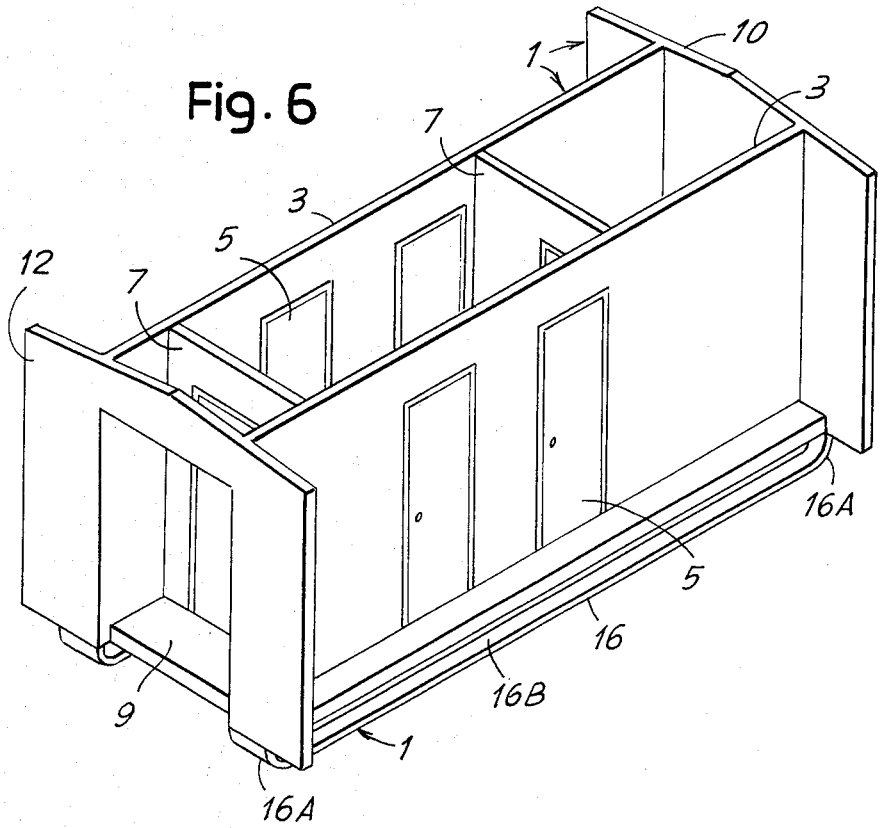
FIG. 6 shows in perspective a supporting framework of the structure of FIGS. 1 to 5 but with the roof omitted.

In accordance with what is illustrated in the accompanying drawings, a main or basic framework 1 is provided, which is shown cross-hatched in FIGS. 1 to 5 and in outline in FIG. 6. This structure comprises in particular: two longitudinal vertical walls 3 or other elongate members, with supporting parts and infill parts and with openings 5 to accommodate communication doors; cross-members 7 to serve as partitions with transit openings, a floor part 9 of the basic structure forming a flooring member; and also, advantageously, infill and/or supporting partitions 10,12 or other end wall members at the ends. The framework structure is completed by a roofing part or member 14, which may also contain inserts contributing towards the strength of the supporting framework, and at the base a pair of longitudinal beams 16, which also form slide runners having at least one end 16A, or better still both ends, curved to serve as runners to aid sliding on the ground. The runner beams 16 advantageously have a double T-shaped cross-section, or other section forming a large lateral outside longitudinal recess as indicated at 16B. The framework will in fact be incorporated in the parts 3,7, 9 and optionally in the parts 10, 12 and 14, in addition to including the runner beams 16; the actual framework will be constructed to provide the required strength and to permit the formation of transit openings, and will advantageously be embedded in infill and protecting parts intended to form walls, floors and roofs.

Figure 8:
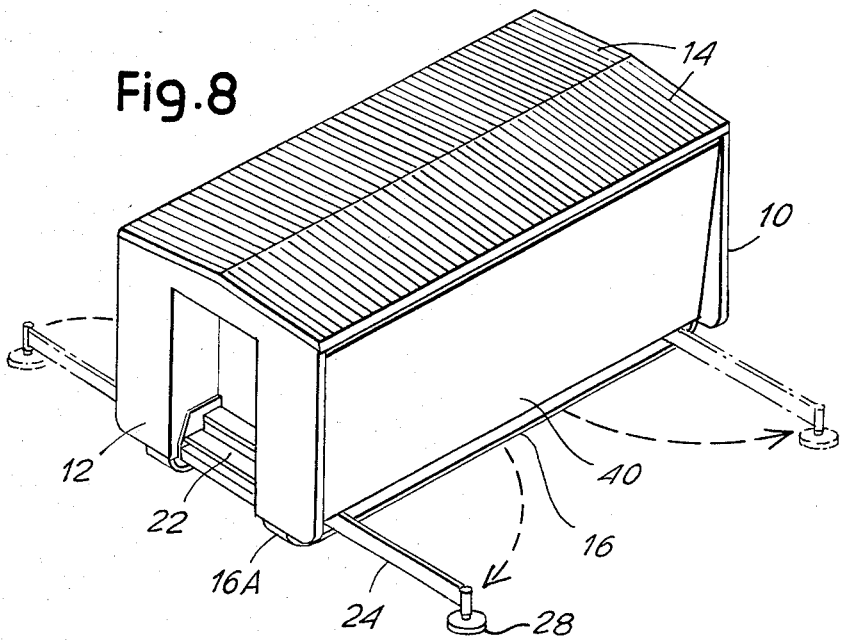
FIGS. 8 to 13 show, in perspective, phases in the conversion of the structure from the storage configurations to the configuration of use.
Figure 9:
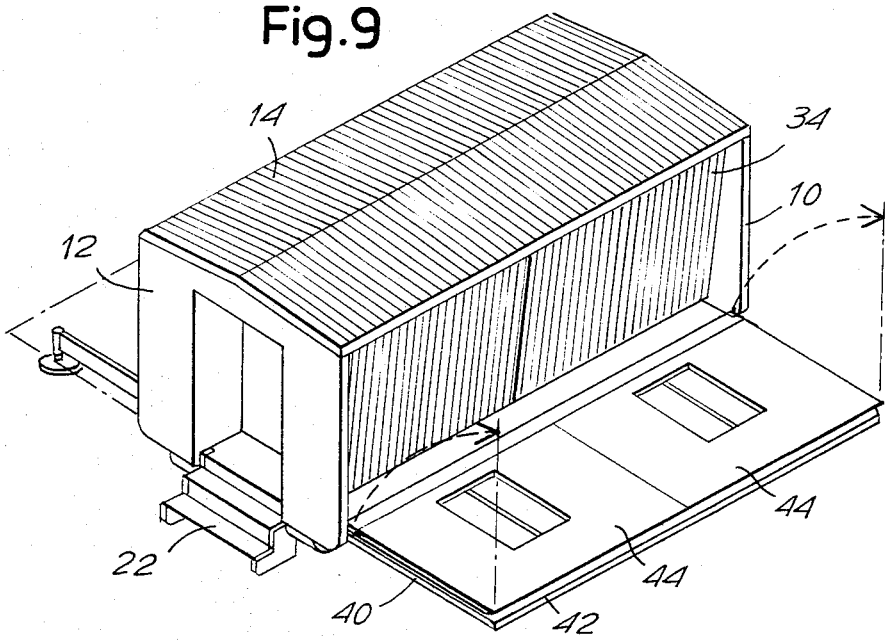
Figure 10:
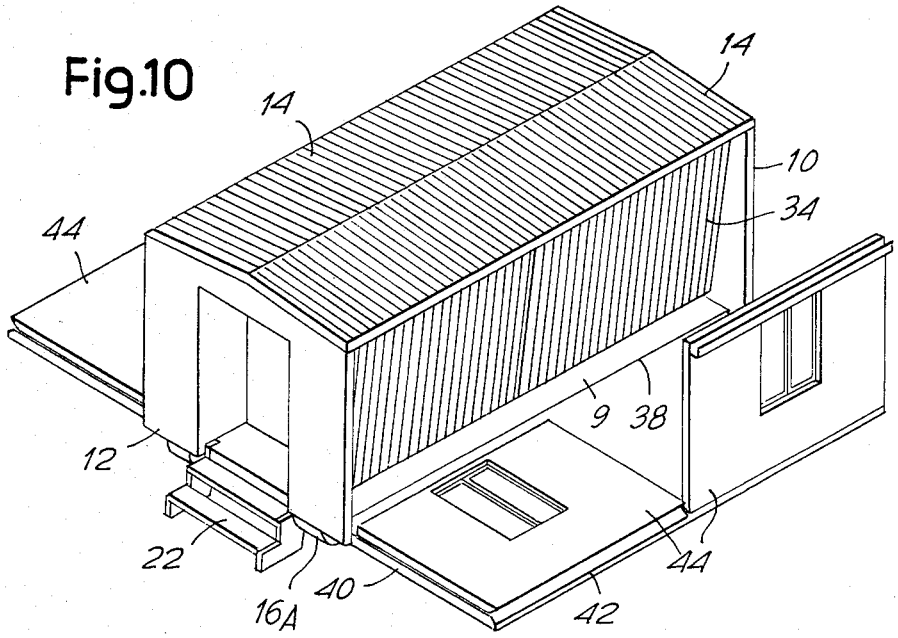
Figure 11:
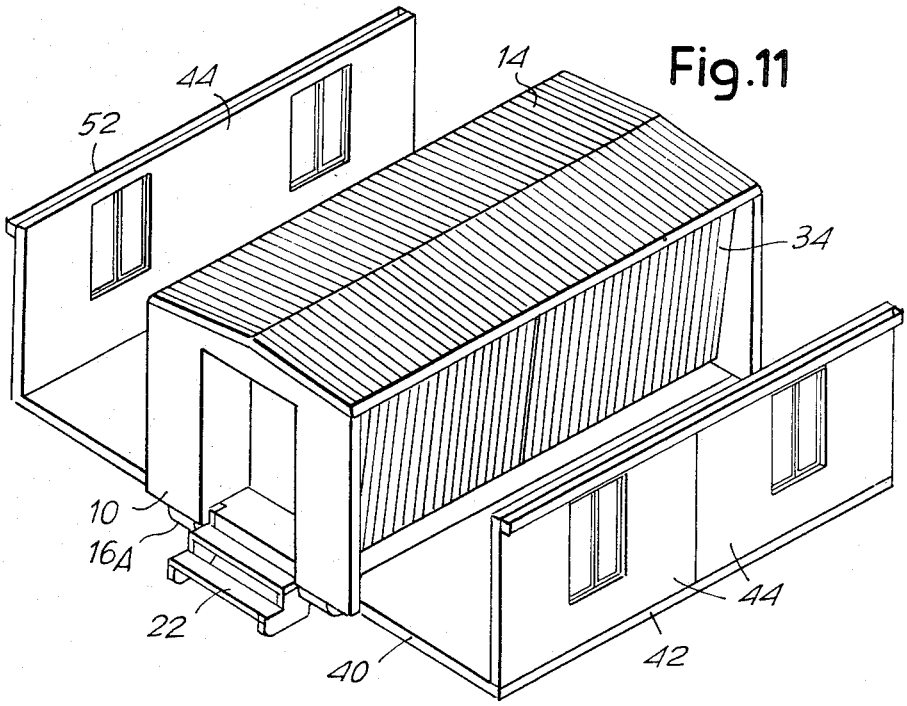
Figure 12:
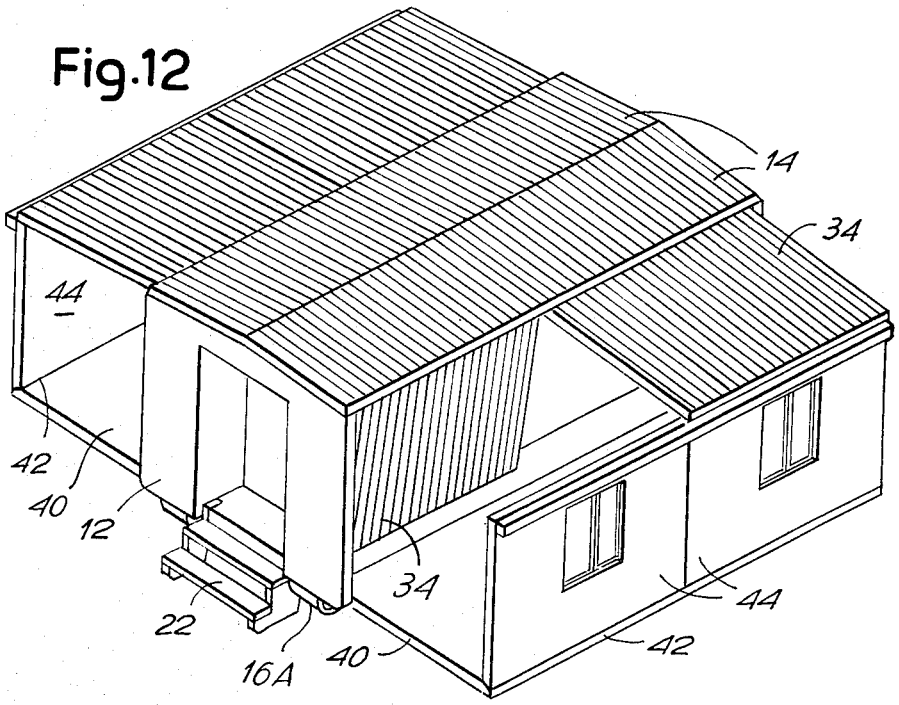
Figure 13:
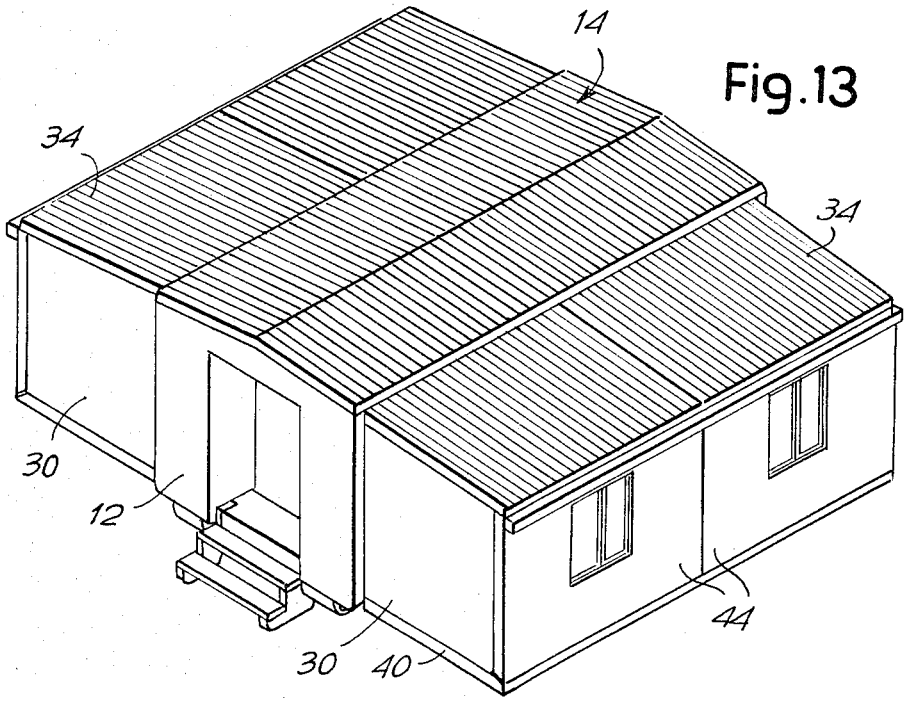
Figure 14:
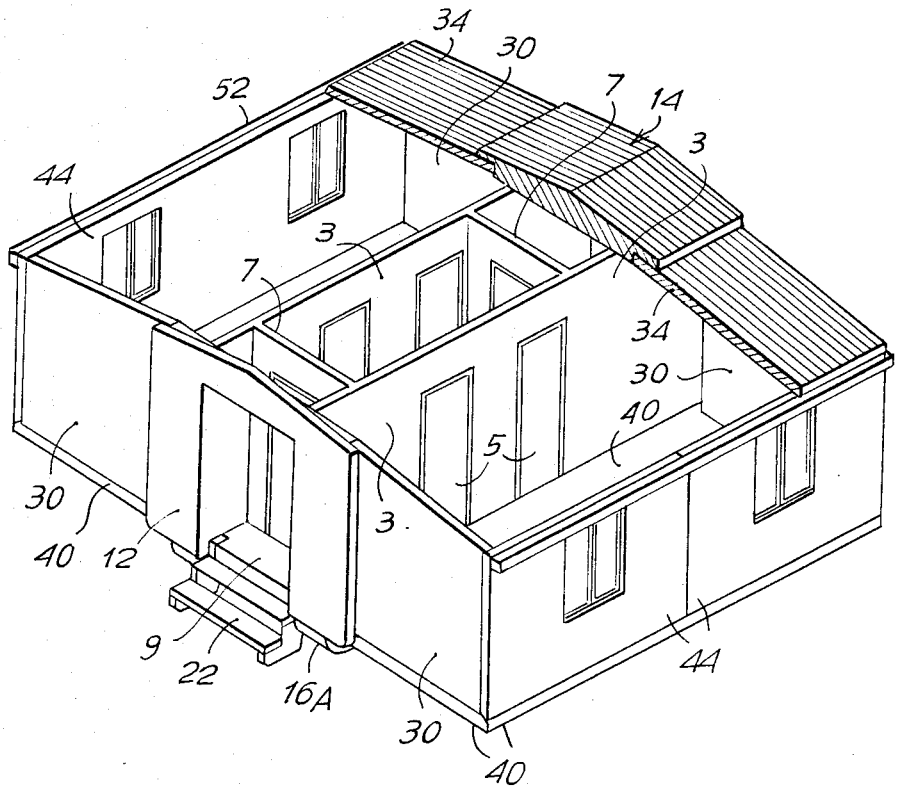
FIG. 14 shows, in perspective, the structure in the configuration of use with a part of the roof omitted.

It will be seen from the drawing that the longitudinal walls 3 are further to the inside than the longitudinal edges of the floor part 9 and also than the edges of the roof 14. Between the two walls 3 a space is formed to serve as a corridor (in use) and for storage (in the storage and transport configuration), and, outside each wall 3, a lateral space open at the sides for purposes to be indicated below, each side space being further delimited by the laterally projecting ends of the end partitions 10 and 12. In the "corridor" space formed between the walls 3, it is possible to install, already in a secured condition, various equipment, such as sanitary equipment 20 for a bathroom or the like. The end partition 12 may accommodate an access door or provide a transit opening for connection to contiguous structures. A part 22 is adapted to fold into and out of the opening and downwards to the ground so as to form access stairs (see FIGS. 8,9,11).

Figure 7:
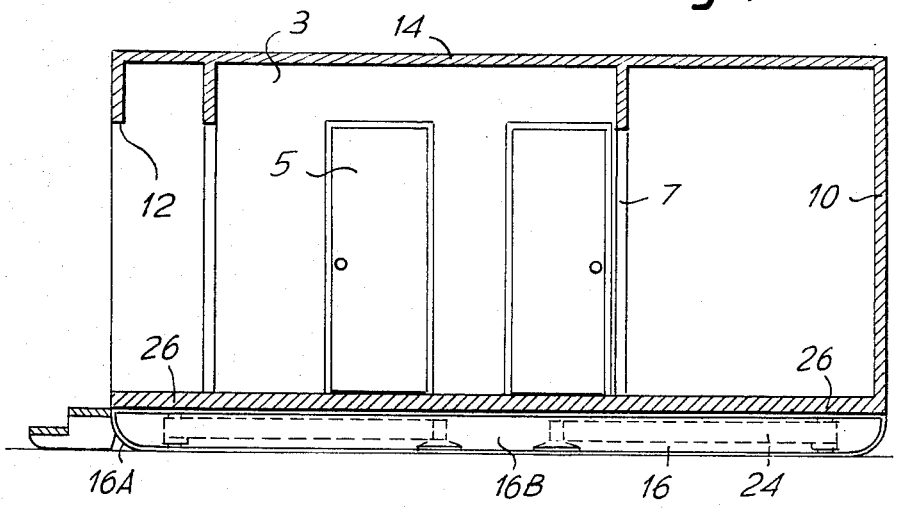
FIG. 7 is a side view, partly in section, showing the storage configuration of the framework of FIG. 6.

The longitudinal runner beams 16 pivotally carry at 26, adjacent each end, pairs of arms 24 (or support legs) on the outer flanges which are movable from a slowed position within the side recesses 16B (FIGS. 1 and 7) to an extended position (FIGS. 2, 8, etc.), in which these arms 24, with the aid of support feet 28, form a support polygon (rectangle as shown) on the ground defining a large area. The support configuration is also adjustable through the (likewise variable) angular location of the arms 24 and through the vertical adjustment of the feet 28. The feet 28 can be adjusted by means of screws and can be removed from the ends of the arms 24, or preferably accommodated together with the arms in the outside lateral recesses 16B of the side beams 16.

The arms 24 can optionally be locked in any desired angular location, as well as within the recesses 16B. The top edges of the opened arms 24 form supports for areas of flooring constituting extensions of the substantially tubular space bounded by the main framework 1 hereinbefore described.

In the lateral space on the outside of each of the walls 3, components are accommodated which are firmly held by means of pivots to the central structure 1 and which are intended to form additional spaces on the side and as continuations of the corridor space defined by the structure 1.

In particular, approximately along the vertical space between the wall 3 and each end partition 10 and 12, a vertical wall part (further panel wall member) 30 is pivoted about a vertical axis 32. The walls 30 can be disposed close against the walls 3 or can be moved outwards as to lie at right angles to the walls 3. In a position further towards the outside, relative to the walls 30, the spaces formed outside the walls 3 can contain roofing parts 34 (further roofing panel members) pivoted at 36 along horizontal axes below the side end zones of the roof 14. The roofing parts 34 can assume a folded configuration on the inside, inclined downwards and inwards (see FIGS. 1 and 5) adjacent to the walls 30; from this configuration the roofing parts 34 can be opened out and raised so as to form extensions of the roof 14 (see FIG. 2).

At the bottom, along the edges of the flooring part 9, flooring parts 40 (further flooring panel members) are pivoted at 38 along a repsective longitudinal edge of the floor 9, and can assume a raised position close to the roofing parts 34 in their folded down configuration. These flooring parts 40, when in the raised position, are slightly inclined with respect to the vertical in an outwards direction; from this position the flooring parts 40 can be lowered—with their weight load under control—until they rest on the top edge of the opened arms 24, so as to form external extensions of the flooring part 9.

Panels 44 (further wall members) are pivoted at 42 to the outer edges of the flooring parts 40, and are intended to form vertical closure walls parallel to the walls 3. These panels may be in one piece or be subdivided into two parts for more convenient handling. The panels 44 may be provided with windows for the rooms formed by means of the panels 30, 40 and 34.

The panels 40 and 44 pivotally connected together horizontally at 42 may be profiled as shown in FIG. 15 in the region of the pivot 42, for sealing purposes, for which purpose seals 48 are used. This Figure also shows the profiling of the panels 44 and 34 for the purpose of co-operation, as will be explained later on, and for sealing purposes with the aid of a seal 50. The seals 48 and 50 are carried by the panels 44. The arrangements illustrated in this Figure also serve to ensure the discharge of water. For this last-mentioned purpose the flooring panel 40 has a terminal edge 40A parallel and opposite to its own pivot 38, and the panels 44 have a bottom profile 44A of the drip type. In addition, the roof panel 34 has a drip type edging 34A and the panel or panels 44 has or have gutters 52 pivoted at 54 to the edge of the panels 44 opposite to the pivot 42. In the folded configuration against the walls 3, the gutters 52 are folded in the manner illustrated in FIG. 5. As an alternative to the arrangement shown in FIG. 15, the panels 40 and 44 may be profiled with an approximately quarter-round bevel to serve the same purposes.

In FIG. 16, like FIG. 15, the co-operating edges of the flooring panel 40, the vertical wall panel 30 and the roof panel 24 are profiled, with respective seals 48A and 50A similar to the seals 48 and 50 (carried by the panel 30), with drip type edges 30A and 34B similar to the edges 44A and 34A.

In FIG. 17 a horizontal section is shown which illustrates the arrangement of a possible detail of sealing members between the part 10(or 12), with a corresponding panel 30 and a corresponding panel 44. In this embodiment the following are provided: a horizontal seal 60 on the panel 30 serving to co-operate with profiled shape of the panel 44 along the edges of the latter at right angles to the pivot 42; a vertical seal 62, also on the panel 30, for the purpose of co-operating with the projecting flange of the part 10 (or 12). Suitable profiles will be given to the pivots.

In the minimum size position the vertical walls 30 are situated immediately outside each of the walls 3, being pivoted at 32 and being disposed, in substantially parallel relationship directly against the respective walls 3. The roofing panels 34 are inclined inwards and downwards adjacent to the panels 30. The whole arrangement of flooring panels 40 and vertical wall panels 44 is included upwards and outwards, approximately parallel to the panels 34, the whole arrangement being still within the space defined by the walls 10 and 12 and the fixed roof 14. It should be noted that the panels 40, which are disposed outside, in the minimum size configuration, present to the outside, in this configuration, their surface which in the position of use faces the ground, supported on the arms 24. In the minimum size configuration the arms 24 are accommodated in the appropriate external longitudinal recesses 16B of the beams 16. The various components described will be locked in the minimum size configuration, in order to facilitate transportion. This transportation may take the form of rail or road transport, or even air transport suspended from helicopters or the like. Movements on the ground can be made directly by sliding the runner beams 16,16A, which effectively withstand the stress consequent on their functioning as runners, in conjunction with the rigid structure attached to them, comprising the parts 9,3,3,14.

When the structure is in situ and in the minimum size configuration, in order to make the structure ready for use (FIGS. 8 to 13), the arms 24 are opened out and the feet 28 are adjusted vertically in order to level the whole assembly. The assemblies 40,44 are then lowered about the pivots 38, so as to rest the flooring panels 40 on the arms 24, which can be adjusted to a position at right angles or inclined by more or less 90° relative to the position in which they are disposed within and parallel to the beams 16. The walls or wall sections 44 are then raised around their pivots 42, until the panels 44 reach a substantially vertical position. The roof panels 34 are then raised about the respective pivot 36, in such a manner as to extend beyond the top edges of the panels 44 and be supported thereon as shown in FIG. 15, after the gutters 52 have pivoted about the hinges 54. The seals 48 and 50 are compressed and deformed to a limited extent, and the drip profiling 34A is adjusted to discharge into the gutters 52. The vertical panels 30 are then turned about the pivots 32 until they come into engagement, at the seals 48A and 50A (FIG. 16), with the panels 40 and 34 along the profiled edges of the latter, which are at right angles to the pivots 38 and 36 respectively. On the opening of the panels 30, their seals 60 and 62 (FIG. 17) are also caused to co-operate with the panels 44 and with the walls 10.

An access opening provided in the wall 12 and/or in the wall 10 permits access to the room which is formed by the arrangement assembled in the manner hereinbefore described, and this room may be subdivided by intermediate panels in relation to the spaces defined inside and outside of the walls 3; this can be effected entirely in accordance with the required purposes.

Figure 18:
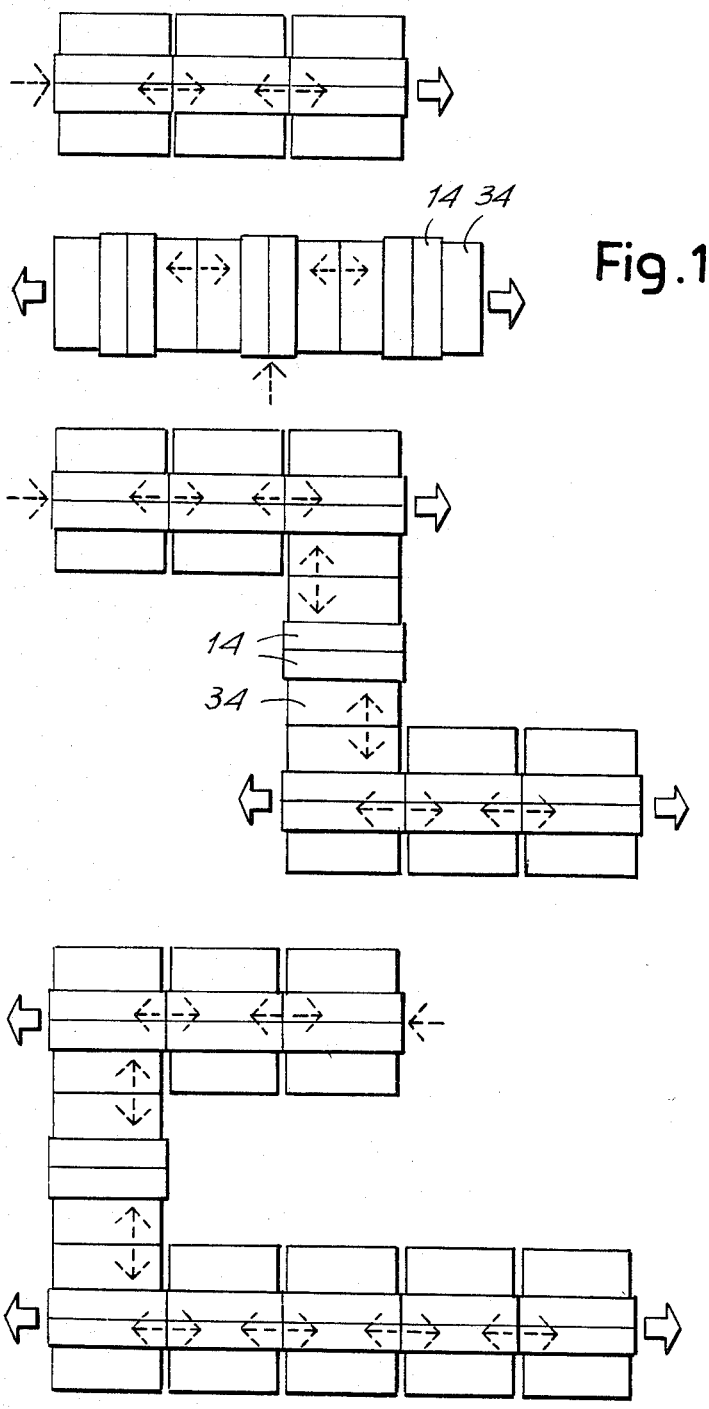
FIG. 18 shows certain possible assembly arrangements including a plurality of structures as described with reference to FIGS. 1 to 18.

FIG. 18 shows possible combinations of a plurality of structures as hereinbefore described, which may be placed contiguously and are made intercommincating by means of apertures provided in the walls 10 and 12 and in the walls 44, as well as optionally in the walls 30.

Figure 19:
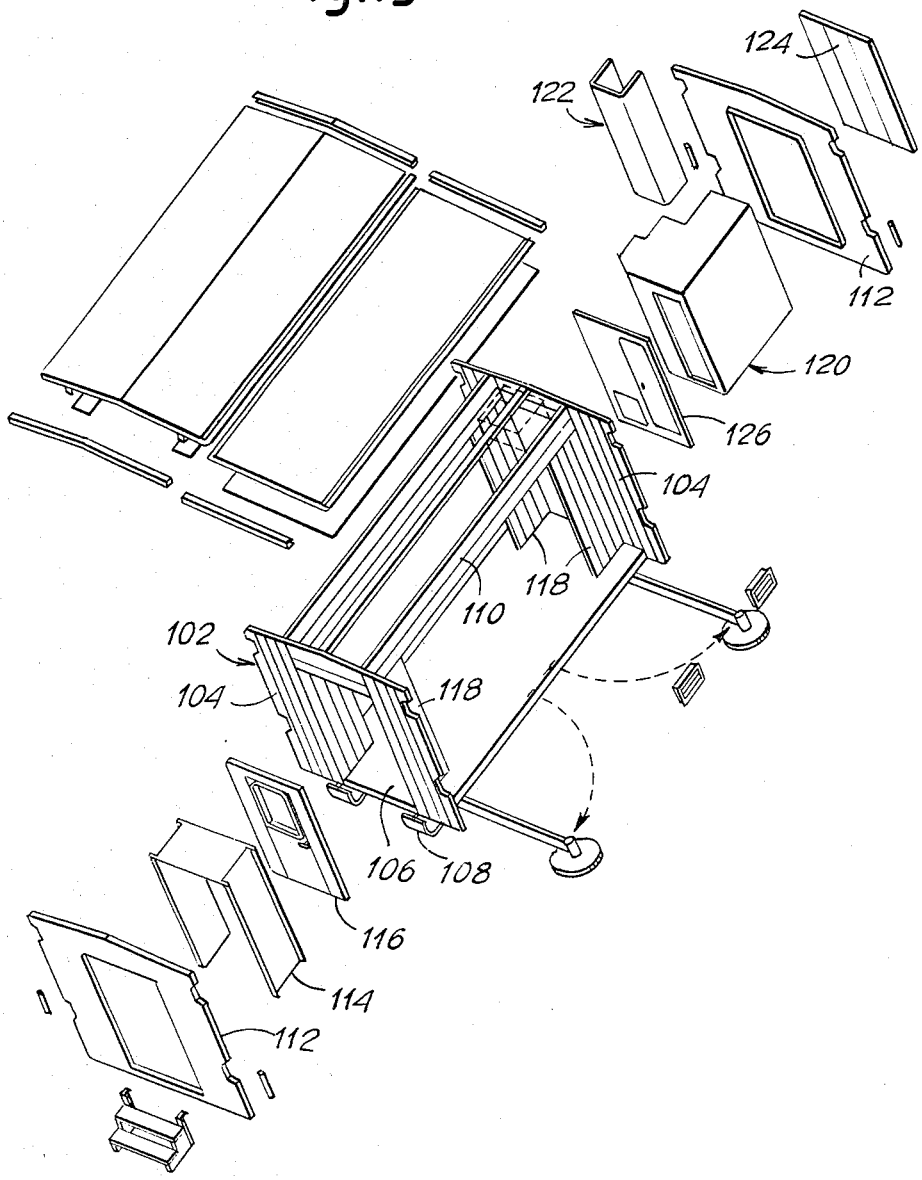
FIG. 19 is a partial exploded view in perspective of a modified embodiment.
Figure 20:
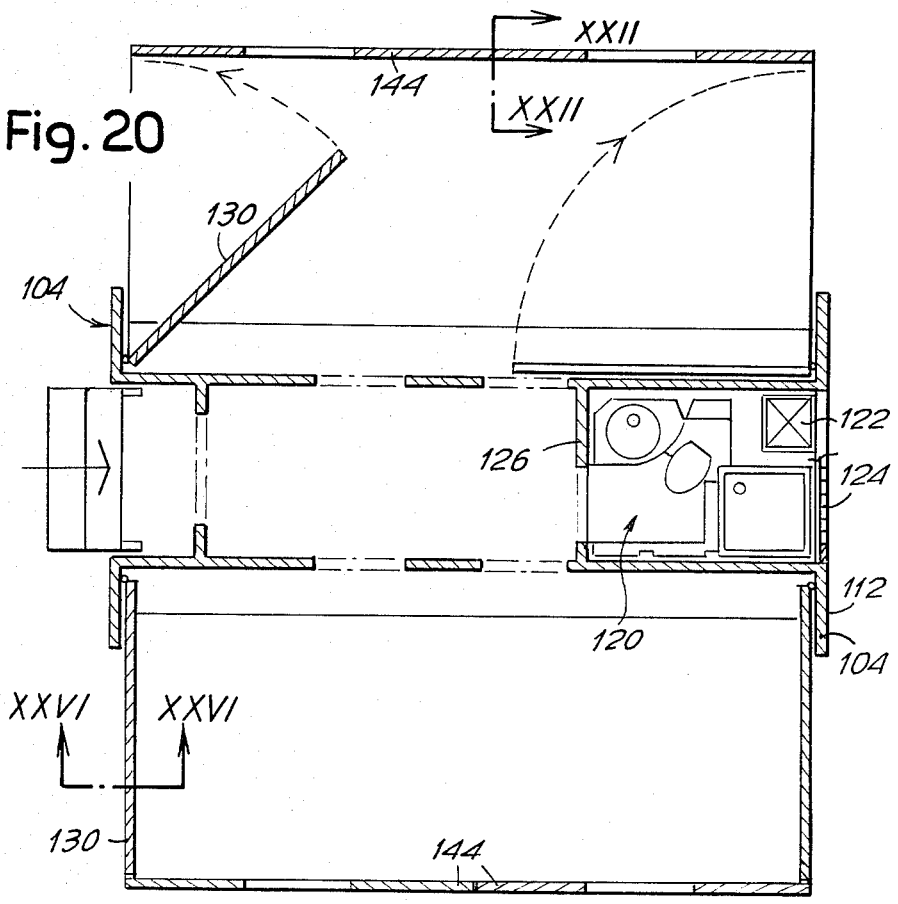
FIGS. 20 and 21 show a longitudinal section of the embodiment of FIG. 19 in the open and closed configurations respectively.
Figure 21:
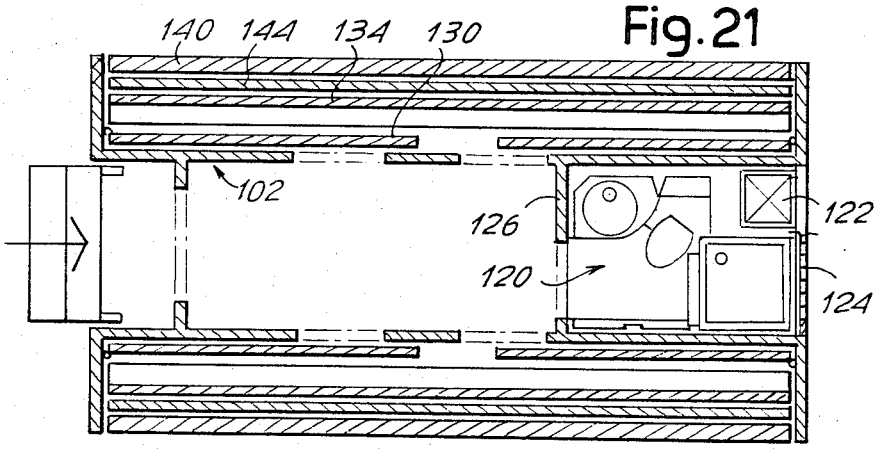

In the modified embodiment shown in FIGS. 19 to 21, the reference numeral 102 indicates generically the supporting framework with end parts 104, floor 106, longitudinal base beams 108 acting as runners, top longitudinal beams 110, arranged similarly to the first embodiment apart from the smaller size of the longitudinal walls, which for the most part are replaced by panels. Reference numeral 112 designates external coverings of the front walls, while 114 and 116 designate internal finishing parts for one of the end parts 104 of the framework 102.

At least one or preferably both of the end parts 104 is or are provided with an opening of a size corresponding to the cross-section of the intermediate space formed by the floor 106, the longitudinal beams 110 and the longitudinal wall parts 118 which are held in the structure 102 between the floor 106 and the beams 110. With this arrangement it is possible to insert into the framework 102, from the outside, a compartment 120 forming an equipped bathroom which can easily be connected to pipes provided externally. The compartment 120 has a profile which leaves space for a cabinet 122 which is accessible from outside by way of the opening in the wall 104, and which contains components which it is preferable to keep separate from the surroundings and accessible from outside, such as a bottled gas reservoir, gas water heaters, electric water heaters, water and electricity meters, and the like. A gridded panel 124 may be fitted to close the opening through which the compartment 120 was inserted.

It will be noted that the compartment 120 can also be disposed in an intermediate position instead of in the end of the space formed by the framework 102, depending on internal distribution requirements. A finishing panel 126 provides for access to the bathroom.

In this embodiment, in which the framework is provided at its ends with the two access openings, that is to say the two openings of the same size as the space formed by the framework, there are ample possibilities for connection between contiguous structures or between a structure and a service module, which will be described and will be illustrated with reference to FIGS. 29 and 30.

FIGS. 22 to 26 show details of a particularly rational form of construction of the movable walls and of the joints between contiguous walls, in an embodiment providing for particularly stable coupling between the panels in the opened position.

Figure 22:
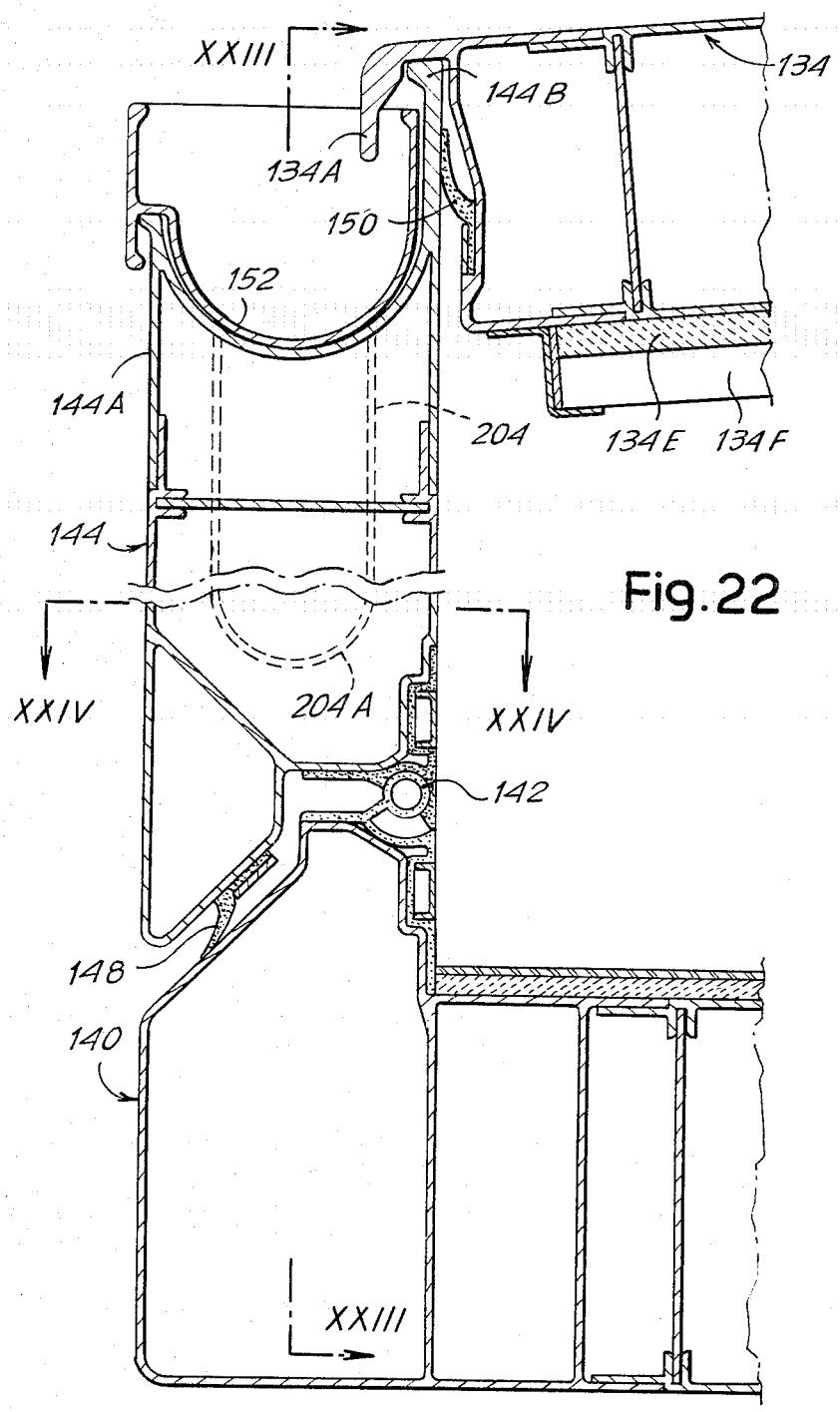
FIG. 22 shows a view in section on the line XXII—XXII of FIG. 20, to an enlarged scale.
Figure 23:
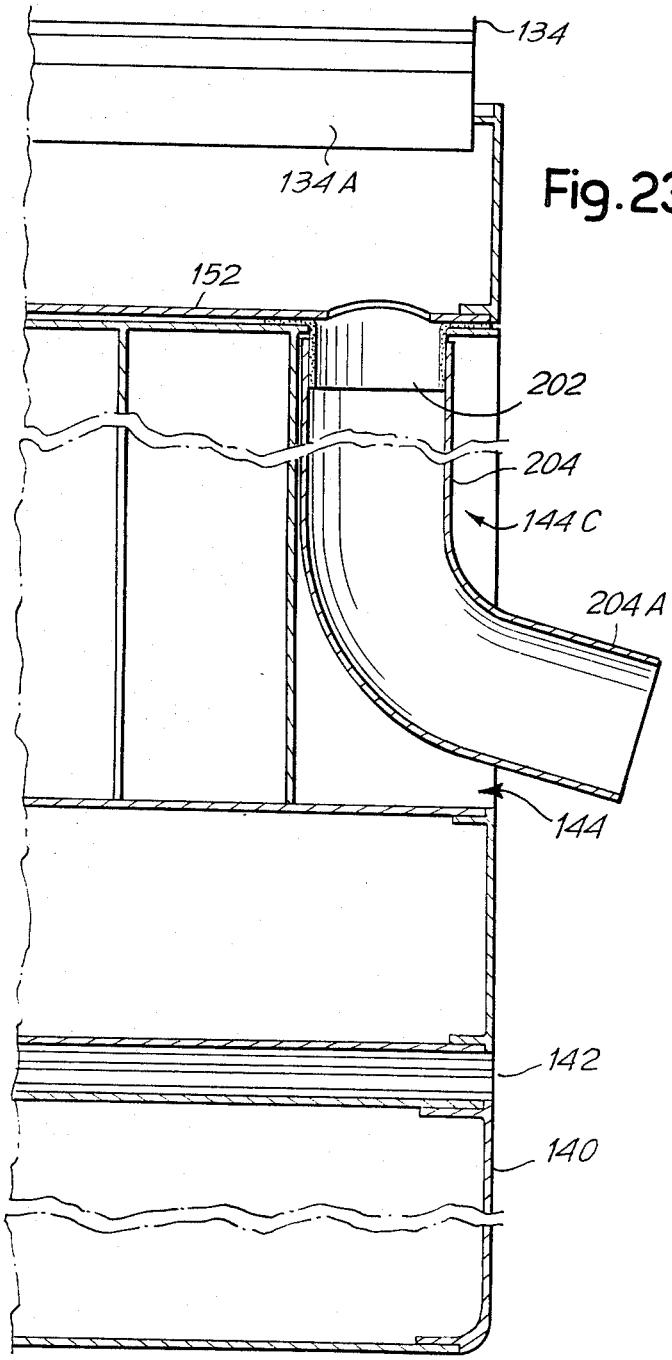
FIGS. 23 and 24 are sections on the line XXIII—XXIII and XXIV—XXIV respectively of FIG. 22.

FIG. 22 shows flooring panels 140, roofing panels 134, and vertical walls 144, corresponding to the parts 40, 34 and 44 in the preceding example. A hinge-like pivot 142 is provided between the flooring panel 140 and the wall 144 which is vertical in the use configuration. The hinge 142 ensures closures with permanent tightness, which in addition is also ensured by a seal 148.

As in the preceding embodiment, the top roofing panel 134 has an edging 134A in the form of a drip member, which in the use configuration penetrates from above into a gutter 152. In the embodiment illustrated this gutter is situated in an end section 144A at the top of the wall panel 144, this section being extended by the inner flange 144B to form a support and seal between the panels 134 and 144, while additionally a seal 150 is provided for this purpose. The gutter 152 is connected with the aid of a seal 202 (FIG. 23), at one end or at both ends, to a respective drainpipe 204, which is installed in a cavity 144C in the vertical edge of the vertical wall 144; this drainpipe terminates at the lower end in an outlet elbow 204A.

Figure 24:
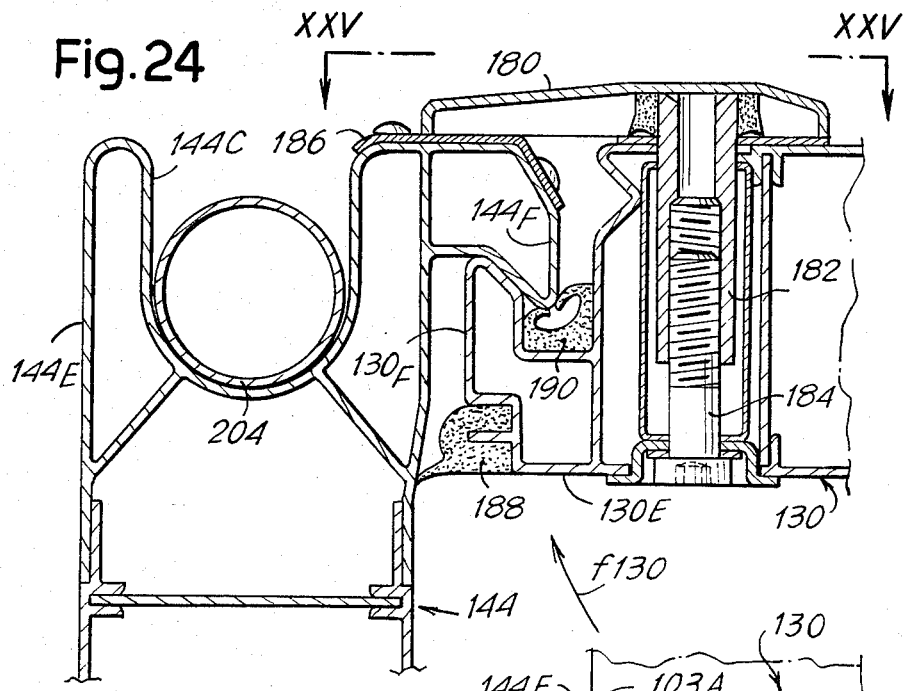
Figure 26:
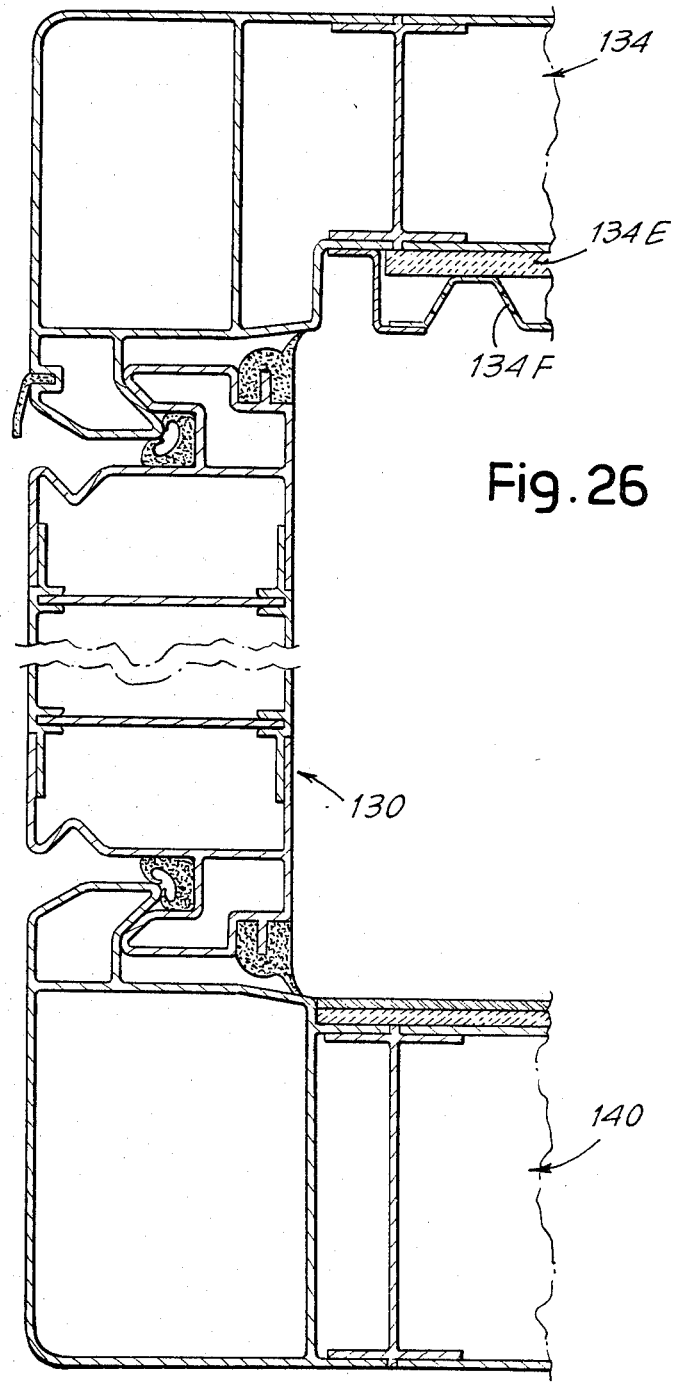
FIG. 26 is a section on the line XXVI—XXVI in FIG. 20.

In this embodiment the vertical walls 130 are pivoted vertically on the inside of the end parts 104 of the framework 102. FIGS. 24 and 26 illustrate the profiling of the wall panels 130,134,140,144—corresponding to the panels 30,34,40 and 44 of the first embodiment, which serve the purpose of strengthening the connection and ensuring the tightness of the latter, the coupling being effected with the aid of particularly simple and quickly-applied means, which are similar for all the joints.

For a detailed description reference will be made to FIG. 24, in which is shown the connection between the wall 144, which is raised vertically about the hinge 142, and the wall 130 which is brought into the use configuration by an angular movement indicated by the arrow f130, so as to be positioned with the movable edge along the vertical edge of the wall 144, where, in this embodiment, the drainpipe 204 is situated.

In addition to defining the channel 144C receiving the drainpipe 204, the edge section 144E of the wall 144 also forms a wedge-shaped extension 144F having an inclined surface. The wall 130 is provided, at its edge forming the movable longitudinal edge, with a section 133 along which extends a wedge-shaped extension 130F adapted to co-operate, at its own inclined surface, with the inclined surface of the extension 144F. In order to make the connection, along the vertical edge of the wall 130 locking members 180 are provided which are pivotal about the axis of hollow pins 182, which are received in a seat formed by the section 130E. The pin 182 is provided with an internal screw thread in which is engaged a bolt 184 operable from the interior of the room.

Figure 25:
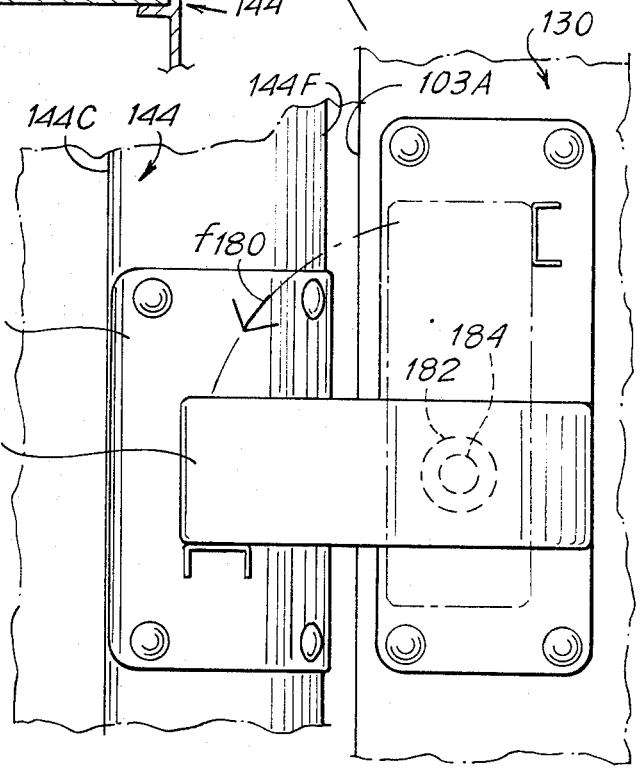
FIG. 25 is a local view on the line XXV—XXV of FIG. 24.

In the position in which the locking member 180 is inoperative, it is situated as shown in broken lines at 180A in FIG. 25, parallel to the edge of the wall 130 defined by the section 103A. When the two walls 130 and 144 are to be coupled and locked, the locking members 180 are turned in the direction of the arrow f180 in FIG. 25, until they lie above and against respective plates 186 provided on the section 144E. The screw 184 is then operated to bring the locking member 180 against the section 144E, 144F, and thus to position correctly the surfaces of the extensions 144F and 130F. The extensions 130F are provided with seals 188 and 190 which co-operate with the section 144F of the wall 144 in order to ensure fluid-tightness. A similar arrangement is provided between the walls 134 and 130 and between the wall panels 140 and 130, as can be seen in particular in FIG. 26. The roofing panel 134 may be provided (inside the room formed by it) with an absorbent anti-condensation layer 134E covered by sheeting 134F, which is ribbed to make the room more comfortable for living purposes in accordance with criteria known per se.

The components shown in FIGS. 19 to 28 and not explicitly referred to are indicated by the same references as in the preceding embodiment, to which they are equivalent.

Figure 27:
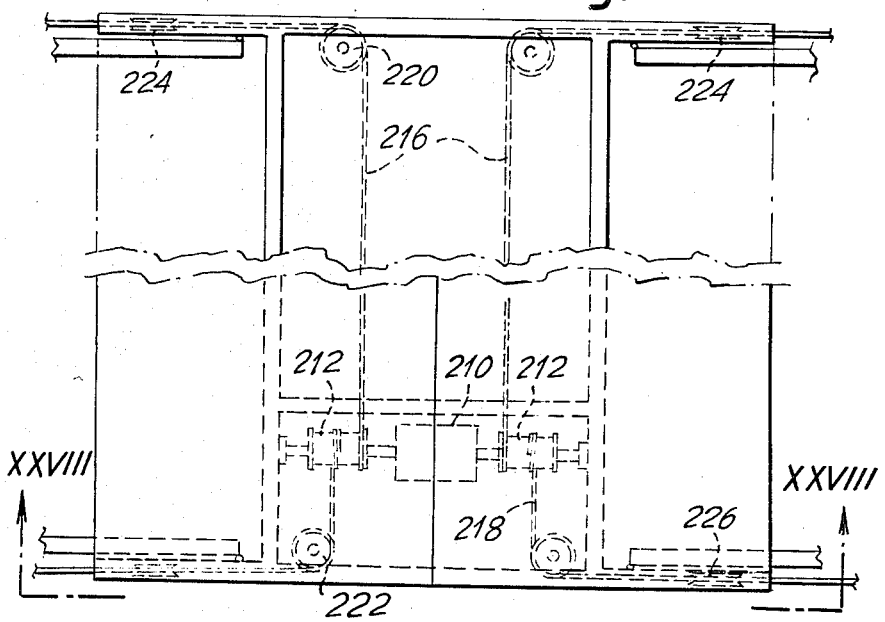
FIGS. 27 and 28 show a system to aid handling during assembly in a plan view and in cross-section respectively on the line XXVIII—XXVIII in FIG. 27.
Figure 28:
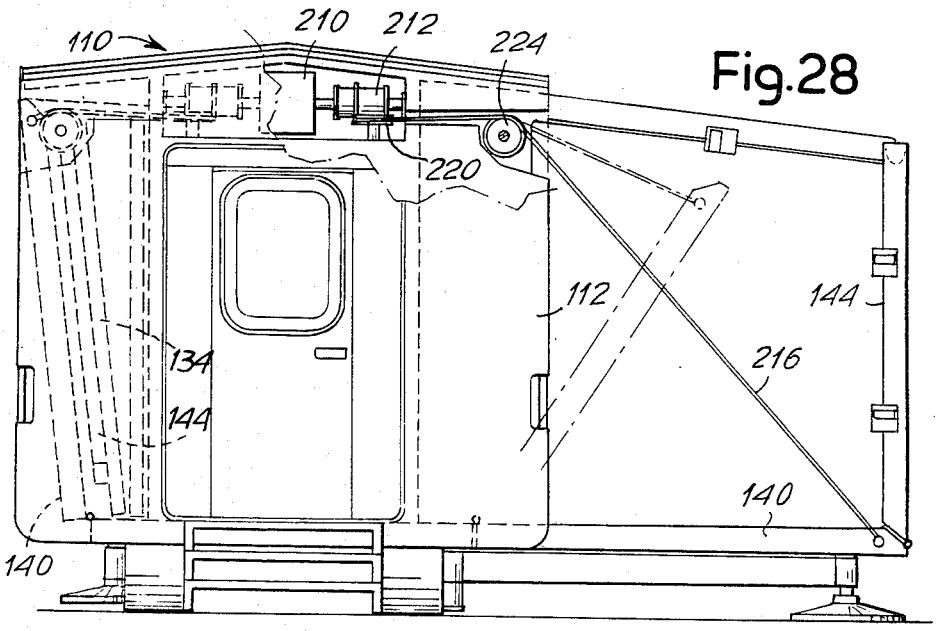

FIGS. 27 and 28 show a system permitting easy handling of the wall panels 140 and 144, which have to be raised and lowered in order to be brought into the storage configuration and the configuration of use respectively. The assembly comprising the two panels 140 and 144 constitutes the heaviest part to be handled. A winch is system 210 of the manual type is provided in the top part of the framework, which winch operates two pairs of winding drums 212 for winding and unwinding a total of four cables 216,216 and 218,218 running over horizontal guide pulleys 220,222 and vertical guide pulleys 224,226, the latter being disposed within the thickness of the front walls 104 and coverings 112. The cables 216 and 218 are anchored laterally on the floor panels 140 in order to permit the raising and lowering operations together with the walls 144, with the aid of the winch 210. The cables 216 and 218 are disengaged from the panels 140 after the latter have been lowered into the use configuration, and returned to the space accommodating the vertical pulleys 224,226.

Although in FIG. 28 one of the floor panels 140 is shown raised and the other lowered in order to facilitate understanding of the drawings, the two opposite panels 140 can actually be operated simultaneously, thus avoiding the necessity of couplings between the winch 210 and the pairs of pulleys 212.

It is helpful to point out that in order to obtain different possibilities of combination of a plurality of rooms formed by the supporting structure, the inside walls can easily be removed in order to form removable or displaceable dividers or partitions. The windows or French windows may be disposed in various positions either in the walls 30 or 130 or in the walls 34 or 134, in accordance with requirements for the distribution of the rooms.

Figure 29:
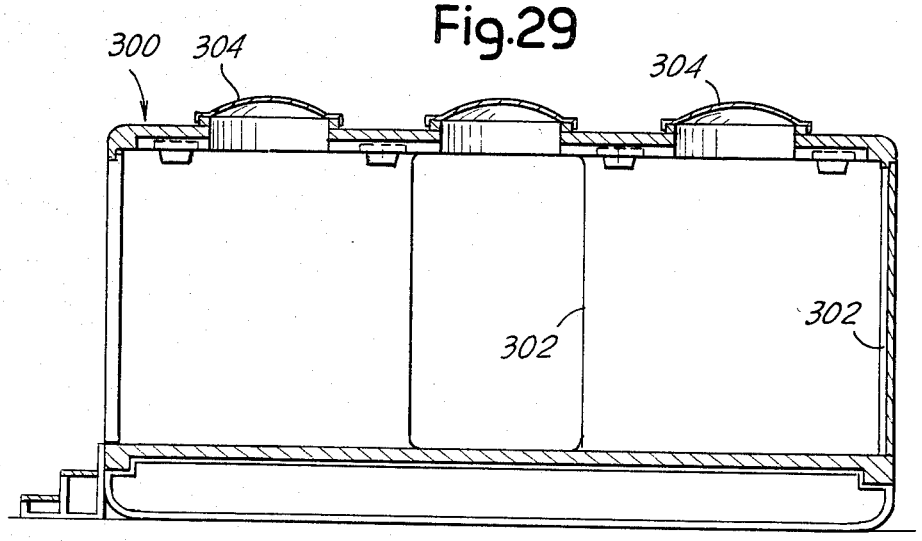
FIGS. 29 and 30 show in vertical section and plan a supplementary service, connection and vestibule module in accordance with a further modification.
Figure 30:
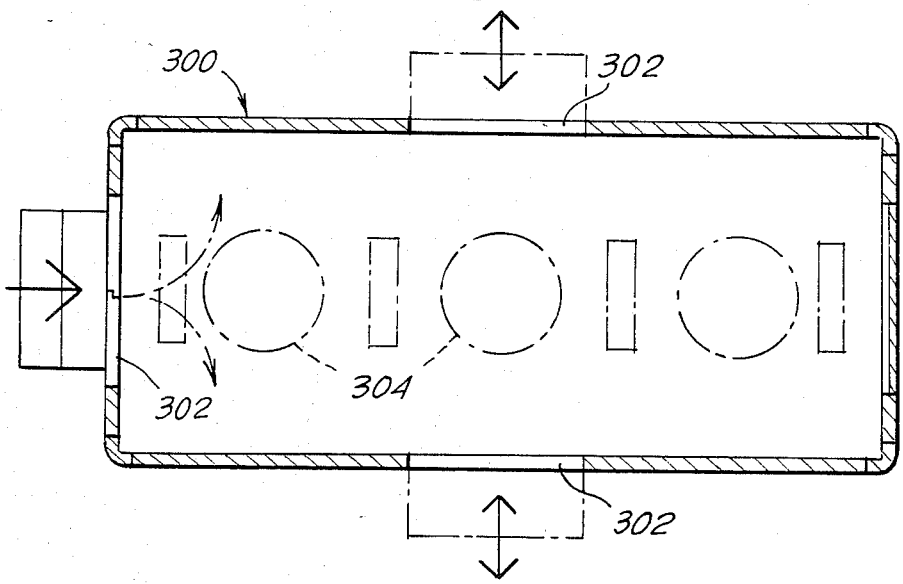
Figure 31:
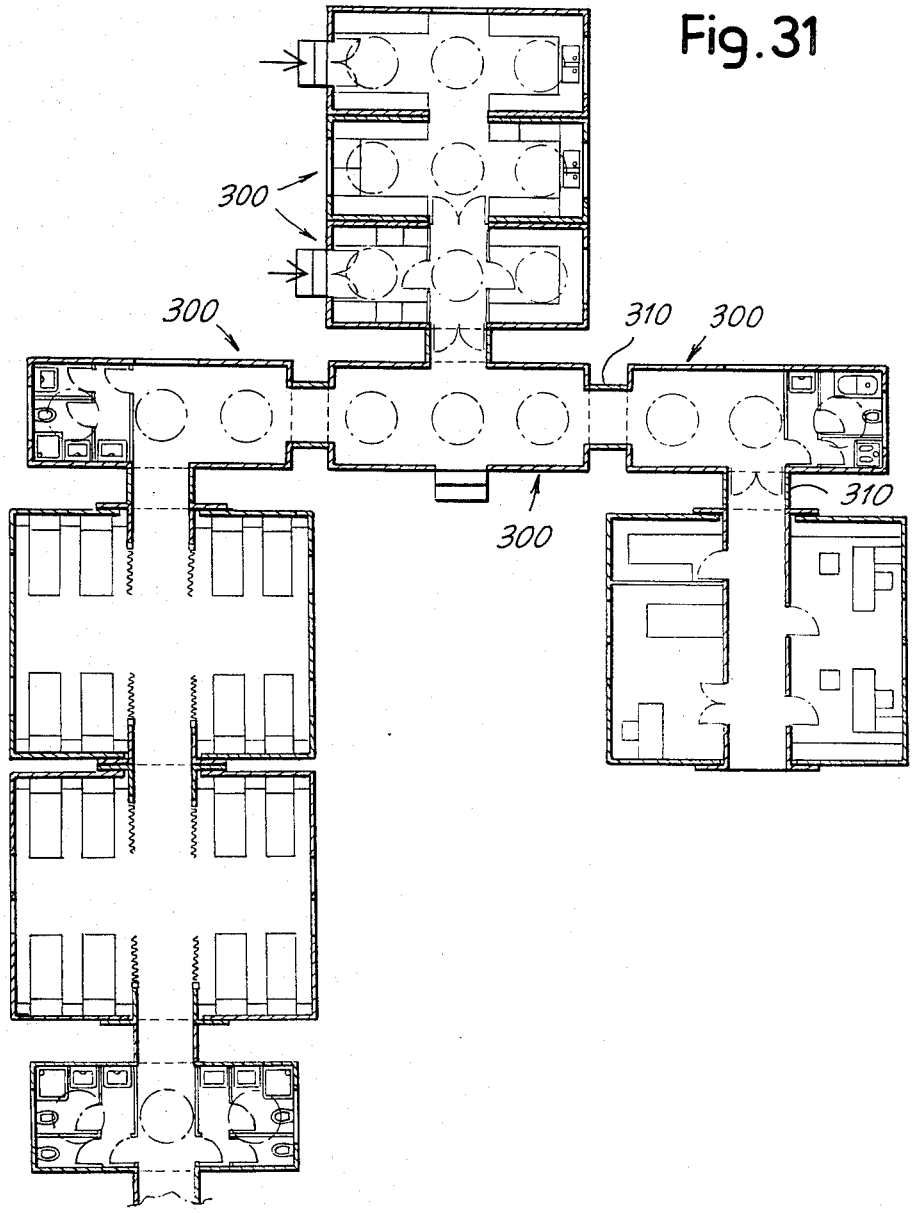
FIG. 31 shows a complex obtainable with the modules of FIGS. 29 and 30 and with the structures described with reference to FIGS. 1 to 28.

FIG. 31 shows as an example a series of possible combinations of rooms formed by the structures in question, and of rooms defined by service modules, such as that shown in FIGS. 29 and 30 and designated 300.

The module can be produced with a structure similar to freight containers, with the characteristic of having, in each of the four walls, an opening 302 and of having, on the ceiling, small domes 304 for ventilation and/or daylight. Compartments obtained with the service module 300 can be variously equipped as shown in FIG. 31, for various services, ranging from hygiene to cloakroom services, kitchen, laundry services, or for constituting directly an operation theatre or resuscitation room or the like. The service modules can also simply constitute intercommunication means for joining rooms formed by the structures described and/or by the said service modules with the aid of suitable connections, such as those designated 310.

I claim:

1. In a building structure a framework including:

elongate members, support and runner base beams, a flooring member, a roofing member, and end wall members, all of these members and beams being rigidly interconnected to define a useful space, further flooring panel members pivoted to the framework at axes extending parallel to the beams and elongate members, further roofing panel members pivoted to the framework at axes extending parallel to the beams and elongate members, further wall members one being pivoted to each further flooring panel member and pivotal, when the corresponding further flooring member is in situ, to a vertical orientation, and further, panel, wall members pivoted to the end wall members about respective vertical axes and movable into configurations wherein corresponding further flooring panel members, further roofing panel members and further wall members together define a further useful space when pivoted to orientations extending outwardly from the framework, and pivotally mounted support legs which are movable from a retracted, storage configuration to an extended configuration when the structure is in situ wherein the legs serve to support the members defining said further useful space, said support and runner beams of the framework have a double T-section defining lateral recesses adapted to accommodate the support legs.

2. A structure according to claim 1, wherein the said panel members of one said further useful space are accommodated, for transportation and storage, between one said end wall member, one said flooring member, and the member forming the roofing.

3. A structure according to claim 1, wherein each further roofing panel member is pivoted below the roofing member of the framework, each further flooring panel member is pivoted to the flooring member of the framework, and each further wall panel member is pivoted to the corresponding further flooring panel member on the opposite side to the pivot axis of the said panel to the framework, the arrangement being such that in the transportation and storage configuration the three panel members lie substantially face to face, the further flooring member being on the outside relative to the framework and the further roofing panel member on the inside.

4. A structure according to claim 3, wherein of the three further panel members lying face to face at least the further flooring panel member and the further wall panel member are slightly inclined upwards and outwards in the transportation and storage configuration.

5. A structure according to claim 1, wherein each further wall panel member and the edge of the further roofing panel member remote from its pivot axis engage with one another, the inter-engaging portions including a drip member on the roofing panel, the structure further including gutter means adjacent said interengaging portions.

6. A structure according to claim 5, wherein the said inter-engaging portions include profiled extensions which have inclined surfaces co-operating to force the panels together when in the use configuration.

7. A structure according to claim 6, comprising pivotal locking members incorporating screw means by which the said inclined surfaces are held together when the structure is in the use configuration.

8. A structure according to claim 1, wherein the end wall members of the framework are provided with openings for access communication with contiguous structures.

9. A structure according to claim 8, wherein the opening in each said end wall corresponds substantially in size to the cross-section of the framework, and wherein the structure further comprises means defining a compartment, bathroom equipment contained within the compartment and means defining a cabinet, and service means contained within the cabinet, said cabinet having an opening registering with a corresponding opening in the said end wall to enable access to the service means without access from internally of the structure.

10. A structure according to claim 9, further comprising means defining additional structures each constituting a service module, each having apertures for combination with the openings in the end walls and with other like modules, a roof member on each module and a dome-shaped transparent member for daylight illumination and for ventilation incorporated in each module roof member.

11. A structure according to claim 1 wherein the framework is provided laterally with an opening for access to one of the further useful spaces.

12. A structure according to claim 1, wherein at least one of the further panel members is made in at least two parts operable independently and the two parts being equipped with seals.

13. A structure according to claim 1, wherein one elongate member of the framework is in the form of a panel with an aperture for access to a contiguous structure.

14. A building structure included a central box-like structure comprising spaced-apart substantially vertical longitudinally extending walls and a roof and a floor both extending laterally beyond each side of said longitudinally extending walls and between said longitudinally extending walls, a transverse wall at each end of said box-like structure extending beyond each side of said longitudinally extending walls, said roof, said floor and each transverse wall and said longitudinally extending wall defining a laterally open space on each side of said box-like structure, an outer roof wall hinged to the upper end of at least one longitudinally extending wall and foldable into said open space on the associated side and being foldable upwardly against a portion of said roof to form a roof extension portion extending outwardly of said roof, a floor extension hinged to said floor and positionable in said laterally open space on an associated side and foldable outwardly to form an extension of said floor, an outer side wall hinged to the outer end of said floor extension positionable in said laterally open space and being foldable upwardly from said floor extension to form an outer side wall connectable to said roof extension, support means extending below said floor defining a laterally open recess on at least one side, a support arm disposed in said recess and hinged to said support means and foldable laterally and outwardly thereof.

15. A building structure according to claim 14, wherein there is a support means on each side of said floor disposed therebelow.

16. A building structure according to claim 14, wherein said transverse wall at each end of said box-like structure has an opening and including a module in the form of a box-like structure having a connecting part connectable to a transverse wall opening and having a ceiling with at least one small transparent dome therein providing means for at least one of ventilation and daylight.

17. A building structure according to claim 14, wherein there are a plurality of box-like structure and including at least one module structure of a box-like shape having at least one roof portion providing a ventilation and light access connected between said box-like structures.

* * * * *